US007871562B2

(12) United States Patent
Silvain et al.

(10) Patent No.: US 7,871,562 B2
(45) **Date of Patent: *Jan. 18, 2011**

(54) MANUFACTURING PROCESS FOR THIN FILMS MADE OF METAL /CERAMIC COMPOSITE

(75) Inventors: Jean-François Silvain, Cestas (FR); Thierry Chartier, Feytiat (FR); Pierre-Marie Geffroy, Pluzunet (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/434,994

(22) Filed: May 4, 2009

(65) Prior Publication Data

US 2009/0208645 A1 Aug. 20, 2009

Related U.S. Application Data

(63) Continuation of application No. 10/433,413, filed as application No. PCT/FR01/03855 on Dec. 6, 2001, now Pat. No. 7,585,456.

(30) Foreign Application Priority Data

Dec. 8, 2000 (FR) ..... 00 15984

(51) Int. Cl.
*B22F 1/00* (2006.01)

(52) U.S. Cl. ..... 419/14; 419/13

(58) Field of Classification Search ..... 419/14, 419/13

See application file for complete search history.

(56) References Cited

U.S. PATENT DOCUMENTS

| | | | |
|---|---|---|---|
| 3,904,473 | A | 9/1975 | Warner et al. |
| 4,003,716 | A | 1/1977 | Stiegelman et al. |
| 4,707,583 | A | 11/1987 | Kim et al. |
| 4,772,322 | A | 9/1988 | Bellis et al. |
| 4,904,411 | A | 2/1990 | Novich et al. |
| 4,916,027 | A | 4/1990 | DelMundo |
| 4,946,808 | A | 8/1990 | Wei et al. |
| 5,002,710 | A | 3/1991 | Shanefield et al. |
| 5,118,026 | A | 6/1992 | Stacher |
| 5,240,782 | A | 8/1993 | Bose et al. |
| 5,405,571 | A | 4/1995 | Truckner et al. |
| 5,473,008 | A | 12/1995 | Hessel et al. |
| 5,511,603 | A | 4/1996 | Brown et al. |
| 5,592,686 | A | 1/1997 | Third et al. |
| 5,660,781 | A | 8/1997 | Moriya et al. |
| 5,902,429 | A | 5/1999 | Apte et al. |
| 6,261,336 | B1 | 7/2001 | Behi et al. |
| 6,296,667 | B1 | 10/2001 | Johnson et al. |
| 6,387,149 | B1 | 5/2002 | Harada et al. |
| 6,605,316 | B1 | 8/2003 | Visco et al. |

FOREIGN PATENT DOCUMENTS

| | | | |
|---|---|---|---|
| EP | 0 294 198 | | 7/1988 |
| JP | 59205433 | | 11/1984 |
| JP | 04141535 | | 5/1992 |
| JP | 07150205 | | 6/1995 |
| RU | 206 4700 | | 7/1996 |
| WO | WO 99/05209 | | 2/1999 |
| WO | WO 99/28068 | * | 5/1999 |
| WO | WO 99/28068 | | 6/1999 |

OTHER PUBLICATIONS

Alcock, J. et al., "Tape Casting -A Flexible Approach To Surface Engineering", Materials Worlds, 2000, p. 13-14.

Böhnlein-Mauβ, J., et al., "The Function Of Polymers In The Tape Casting Alumina", Advanced Materials, 1992, p. 73-81, vol. 4, No. 2.

Fujikura, Kasei K.K., XP 002196023, Japan Abstract, 9(135) 1985 (RU 2064700).

Moreno, Rodrigo, "The Role Of Slip Additives In Tape Casting Technology: Part I—Solvents and Dispersants", American Ceramic Society Bulletin, 1992, p. 1521-1531, vol. 71, No. 10.

Moreno, Rodrigo, "The Role Of Slip Additives In Tape Casting Technology: Part II—Binders and Plasticizers", American Ceramic Society Bulletin, 1992, p. 1647-1657, vol. 71, No. 11.

* cited by examiner

*Primary Examiner*—Roy King
*Assistant Examiner*—Jessee R. Roe
(74) *Attorney, Agent, or Firm*—Brinks Hofer Gilson Lione

(57) ABSTRACT

Process for manufacturing composite metal/ceramic thin films, consisting of:

a) preparing a suspension (S) in an organic solvent starting from a substantially homogenous mixture of ceramic reinforcements, metallic particles, a binder, a plasticizer and a dispersant, the metallic particles constituting at least 5% by weight of the suspension;

b) tape casting the suspension to form a thin film, and then de-binding said thin film;

c) densifying the de-binded thin film in a furnace.

9 Claims, 2 Drawing Sheets

MANUFACTURING PROCESS FOR THIN FILMS MADE OF METAL /CERAMIC COMPOSITE

This application is a continuation of U.S. application Ser. No. 10/433,413, filed Jun. 4, 2003 now U.S. Pat. No. 7,585,456, which application is a National Stage application of International Application No. PCT/FR01/03855, filed Dec. 6, 2001, the entire contents of which are incorporated herein by reference. This application also claims the benefit under 35 U.S.C. §119 of French Patent Application No. 0015984, filed Dec. 8, 2000, the entire contents of which are incorporated herein by reference.

FIELD OF THE INVENTION

The invention relates to a process for manufacturing thin films made of metal/ceramic composite in which the ceramic reinforcements are homogeneously distributed in the metallic matrix.

The invention is used for applications in all fields using substrates or films made of a metal/ceramic composite and particularly for manufacturing electronic components, for example designed for the automobile or aeronautics field.

BACKGROUND OF THE INVENTION

Conventionally, metallic films are made by a rolling process. However, this rolling process cannot provide a uniform distribution of ceramic reinforcements within the metallic matrix; therefore, it is not suitable for manufacturing metal/ceramic Composite films. Furthermore, residual stresses caused by rolling can cause cracking of the film if the concentration of ceramic powder is above a given value.

Other processes used for making metal/ceramic composite films include pressing, injection and extrusion processes. None of these processes is capable of obtaining film with an excellent surface condition. Furthermore, these processes become expensive if the film has to be less than one millimeter thick.

There are also tapes casting processes for making thin films. This type of process is described in articles by ALCOCK J., DESCRIBE S., Tape casting, a flexible approach to surface engineering, Materials World, 13-14, Feb. (2000), BÖHNLEIN-MAUβ J., SIGMUND W., WEGNER G., MEYER W. H., HEβEL F., SEITZ K, ROOSEN A., The function in the tape casting of alumina, Advanced Materials, vol. 4, No. 2, 73-81 (1992); MORENO R., The role of slip additives in tape casting technology: part I—Solvents and dispersants, American Ceramic Society Bulletin, vol. 71, No. 10, 1 521-1 531 (1992); MORENO R., The role of slip additives in tape casting technology: part II—Binders and Plasticizers, American Ceramic Society Bulletin, vol. 71, No. 11, 1 647-1 657 (1992) and U.S. Pat. Nos. 5,002,710 and 5,473,008.

However, despite all the work done on tape casting, there is no device (bench+suspension) capable of casting tapes made of metal/ceramic composite material.

SUMMARY OF THE INVENTION

The purpose of the invention is precisely to overcome problems with processes for manufacturing thin films described previously. To achieve this, it proposes a process for making thin films made of a metal/ceramic composite using a tape casting method.

More precisely, the invention relates to a process for manufacturing composite metal/ceramic thin films, consisting of:

a) preparing a suspension (S) in an organic solvent starting from a substantially homogenous mixture of ceramic reinforcements, metallic particles, a binder, a plasticizer and a dispersant, the metallic particles constituting at least 5% by weight of the suspension;

b) tape casting the suspension to form a thin film, and then de-binding said thin film;

c) densifying the de-binded thin film in a furnace.

The tape casting technique allows to orient and control the distribution of ceramic reinforcements.

In other words, the process described according to the invention is a means of making composite metal/ceramic films with an orientation of ceramic particles in the plane of the film, particularly for highly anisotropic particles, like fibres and platelets. This allows to improve some properties of the composite in the plane of the film, such as reducing the coefficient of thermal expansion and increasing the thermal conductivity.

Advantageously, the viscosity of the suspension is between 0.5 and 3 Pa·s.

Preferably, the suspension is made by mixing:

at least one metallic powder and at least one ceramic reinforcement constituting about 30 to 60% of the total volume of the suspension;

an organic solvent constituting about 15 to 45% of the volume of the suspension;

a binder and a plasticizer constituting about 30 to 70% of the volume of the suspension;

a dispersant representing about 0.1 to 2% by weight of the ceramic and metallic powders; and additives representing about 0.01 to 2% of the mass of metallic and ceramic powders.

According to one embodiment of the invention, the dispersant is a phosphoric ester, a polyacrylate, a sulfonate, a perfluorate or an acid with a carbon chain having 2 to 30 atoms of carbon.

According to the invention, the metallic powder, may be a copper, aluminium, silver, gold, nickel, titanium, chromium or zinc powder, or an alloy of two or more of these materials. The ceramic reinforcement may be a powder and/or a short fibre (i.e. a fibre which length ranges from 1 and 500 μm) of graphite, carbides, nitrides or oxides.

According to one variant of the invention, densification of the film consists in sintering the film in a furnace.

According to another variant of the invention, densification of the film consists in hot rolling and annealing the film.

Preferably, the preparation of the suspension consists in:

grinding the metallic powders and ceramic reinforcements in a jar mill or by attrition with the solvent and dispersant; then adding and mixing a binder and a plasticizer to this substance.

The invention also relates to a process for preparing composite parts with a laminated structure in which several thin films ("green" films) are formed by steps a) and b) described above, and said thin films are then stacked and the stack is subjected to thermocompression.

Preferably, the compositions of the stacked thin films are different.

DETAILED DESCRIPTION OF EMBODIMENTS

The invention relates to a process for making thin films made of a metal/ceramic composite.

This process consists of preparing a suspension, also called a "slurry" ("barbotine" in French), comprising a substantially homogenous mixture of ceramic reinforcements and metallic particles.

These metallic particles and ceramic reinforcements are chosen in the form of one or several metallic powder(s) and one or several ceramic reinforcement(s), respectively. These powders and short fibres are mixed with an organic solvent, a dispersant, a binder and a plasticizer.

The amount of these various elements is as follows:

- metallic powders and ceramic reinforcements represent 30 to 60% of the total volume of dry matter in the suspension (in other words of the entire volume occupied by the binder, the plasticizer, the dispersant and metallic and ceramic powders);
- the solvent represents 15 to 45% of the total volume of dry matter;
- the binder and the plasticizer represent 30 to 70% of the volume of dry matter;
- the dispersant represents between 0.01 and 2% of the mass of metallic powders and ceramic reinforcements;
- other additives are added such as release agents and/or wetting agents, that represent between 0.01 and 2% of the mass of metallic and ceramic powders.

Figure 1:
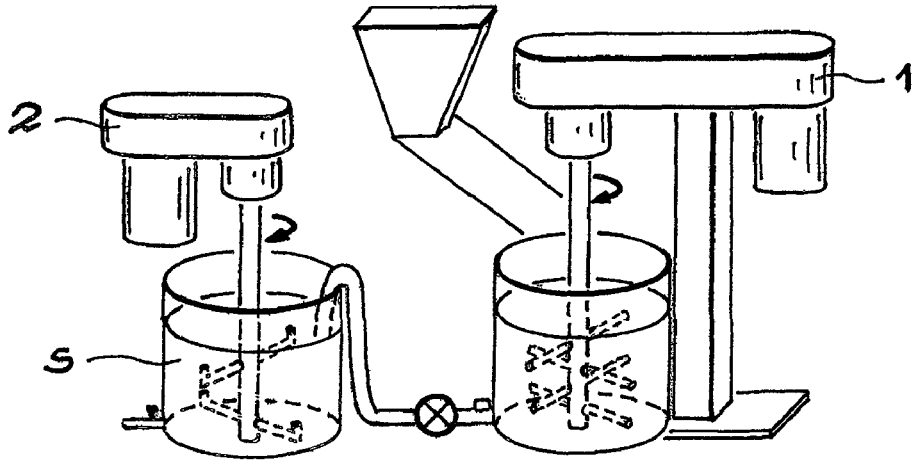
FIG. 1 diagrammatically shows the suspension preparation step starting from metallic particles and ceramic reinforcements.

FIG. 1 shows this first step in the process according to the invention, namely the suspension preparation step.

This step for preparation of the suspension S consists firstly in grinding the metallic and ceramic powders with the solvent and the dispersant, in a jar or by attrition. This grinding step is done using an attrition grinder (represented by reference 1 in FIG. 1) or by a jar mill.

The assembly thus obtained is then mixed with binders and plasticizers using a mixer, reference 2.

For example, the metallic powder(s) that will form the metallic matrix of the suspension may be a copper, aluminium, silver, gold, nickel, titanium, chromium or zinc powder, or a powder of an alloy of two or more of these metals.

The ceramic reinforcement(s) that will form the ceramic reinforcements of this suspension may for example be a graphite powder or a short graphite fibre, or a powder or a short fibre based on carbides such as silicon carbide, or nitrides such as aluminium nitride, or oxides such as silica or zirconium tungstate.

Ceramic reinforcements may be in the form of fibres or platelets or substantially spherical grains with a diameter of between about 0.1 μm and 100 μm.

Fibres are usually short fibres with a diameter of 10 nm to 10 μm, and with a length of 100 nm to 10 nm.

These ceramic reinforcements may be coated with a layer of metallic material such as cobalt, nickel, silver or gold. In this case, the thickness of the metallic coating is at least 0.01 μm. This coating may be achieved by immersion of the ceramic reinforcements in an electrolytic bath. The advantage of this coating is that it improves material densification during the film densification step, and in particular when this densification consists in sintering, since it increases the metal/ceramic interface.

The suspension used according to the invention is an organic suspension or system.

Thus, the solvent used to make this suspension S is an organic solvent, usually chosen from among cetones, alcohols and mixtures thereof.

The function of the dispersant used to make this suspension is to make the suspension homogenous and stable by creating repulsion forces between the ceramic reinforcements and the metallic particles.

In other words, the dispersant enables good stability and good dispersion of the particles among each other. The dispersant enables production of a homogenous and compact tape after drying.

This dispersant is chosen from among surfactants, macromolecules like fish oil, phosphoric esters, polyacrylates, sulfonates, perfluorates and acids with a carbon chain having 2 to 30 atoms of carbon, such as for example oxalic acid and stearic acid.

The binder used to make this suspension plays the role of unparting cohesion to the tape (or film) after the solvent has evaporated. This binder is usually a compound that is non-soluble in water and is chosen from among polyalcohols, vinyl compounds, such as polyvinyl-butyral, and acrylic compounds and mixtures thereof.

The plasticizer used in this suspension plays the role of unparting good flexibility and good fluidity to the tape; this flexibility is necessary when the suspension is being tape cast and later when handling the tape. For example, this plasticizer may be a polyethylene glycol or dibutylphthalate.

In other words, the suspension also contains a plasticizer to obtain a flexible, sufficiently strong, green tape, or thin film, so that it can be handled. The binder/plasticizer ratio is a means of adjusting the mechanical cohesion and flexibility of the tape. Therefore, these tapes can be stacked and thermo-compressed so as to make stacks of tapes with different compositions. This solution cannot be achieved with processes according to prior art.

Note also that the system and the suspension used according to the invention do not require any lubricant.

Figure 2:
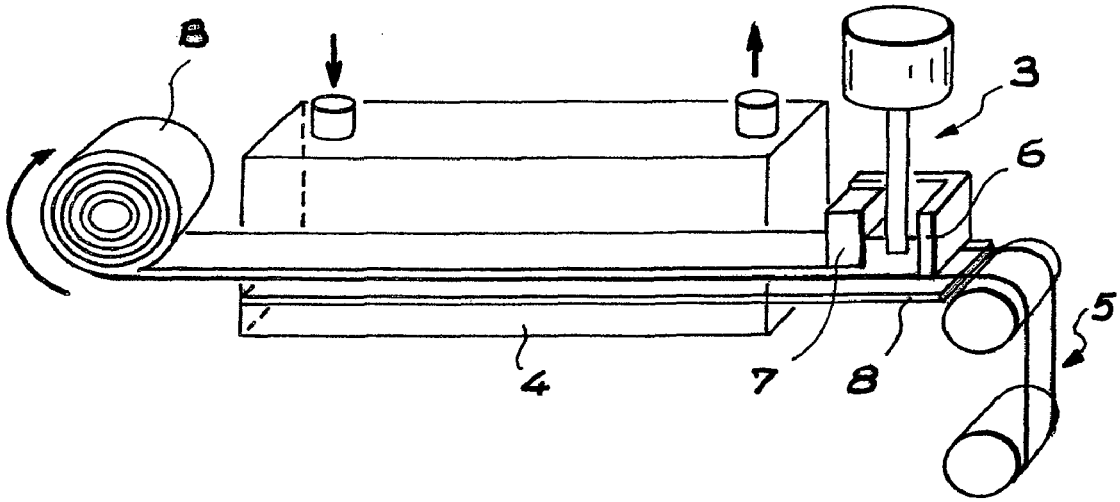
FIG. 2 diagrammatically shows the tape casting step of the suspension to form a thin film.

FIG. 2 diagrammatically shows the second step of the process according to the invention, in other words the tape casting step of the suspension. The suspension S made during the first step is cast onto a casting bench 3 so as to form a tape B, also called a thin film. Tape casting consists of casting the suspension S on a support that may for example be a steel tape 8 or a polymer wire, reference 5 in FIG. 2. The viscosity of the suspension must be of about 0.5 to 3 Pa·s to facilitate casting of the suspension.

The suspension is cast by creating a relative movement between a shoe 6 on the casting bench and the support 5. The shoe 6 is provided with knives 7 with an adjustable height. Thus, the film thickness can be modified by changing the height between these knives 7 and the support 5. Thus, a very uniform film thickness can be obtained using this tape casting method.

When the suspension S has been cast in the form of a tape B, the tape B is passed through a drier 4 under a controlled atmosphere, to eliminate organic compounds. This step is called "de-binding". More precisely, thermal de-binding consists of gently heating the tape of material under a controlled atmosphere in a furnace or dryer 4 in order to eliminate the contained organic compounds, mainly the binder and the plasticizer. For example, the heating rate in the drier is about 0.2 to 2° C./minute between 100° C. and 500° C.

Figure 3A:
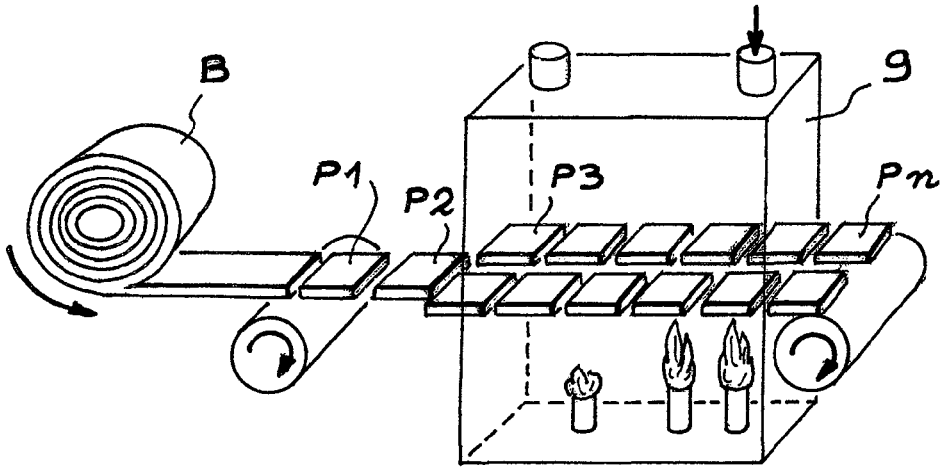
FIGS. 3A and 3B show two embodiments of the film densification step in a furnace.
Figure 3B:
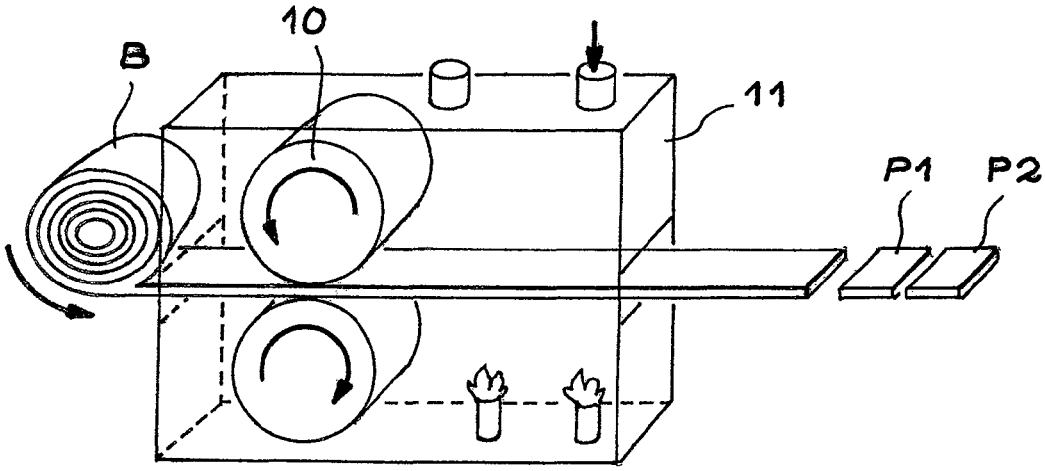

FIGS. 3A and 3B show two different embodiments of the third step of the process according to the invention, in other words the film densification step.

This densification step consists in evaporating the solvent and drying the thin film obtained after de-binding.

The purpose of this film densification step is to evaporate the solvent. For example, this may be done in two different ways: the film may be densified by sintering in a passage furnace or in a discontinuous furnace, or by hot rolling using a roll and an annealing furnace.

The first variant shown in FIG. 3A shows that the film B obtained after de-binding is cut into plates P1 to Pn. These plates are inserted in a furnace reference 9 under a controlled atmosphere. This furnace may be a passage furnace or a discontinuous furnace. Densification by sintering is done under a controlled atmosphere, or under a reducing atmosphere, for example such as hydrogen, hydrogenated nitrogen, argon or hydrogenated argon, in order to prevent oxidation of the material.

The sintering temperature depends on the particle size and nature of the metallic powders and ceramic reinforcements. For example, for a metallic copper powder, the temperature is between 700° C. and 1080° C.; for aluminium, the temperature is between 450° C. and 650° C.

The second variant of the densification step is shown in FIG. 3B. In this variant, the film B is inserted in a roll 10 inside an annealing furnace 11. The film B is then hot rolled in the furnace 11 under a controlled atmosphere. The film B is cut into plates P1, P2, . . . at the exit from the annealing furnace 11.

This film hot rolling and annealing densification method allows to improve the densification of the material under the action of pressure and temperature. Therefore this variant is particularly suitable for metal/ceramic composites that are not well densified by natural sintering and for composites constituted by ductile metals like copper, aluminium or gold.

The invention claimed is:

1. Process for manufacturing composite metal/ceramic thin films, consisting of:

a) preparing a suspension (S) in an organic solvent starting from a substantially homogenous mixture of ceramic reinforcements, metallic powder, a binder, a plasticizer and a dispersant, the metallic powder constituting at least 5% by weight of the suspension, wherein the metallic powder is copper, aluminum, silver, gold, nickel, titanium, chromium, zinc, or an alloy of these materials;

b) tape casting the suspension to form a thin film, and then de-binding said thin film; and c) densifying the de-binded thin film in a furnace by hot rolling under a controlled or reducing atmosphere and then annealing the film;

d) wherein the suspension (S) is made by mixing:

at least one metallic powder and at least one ceramic reinforcement constituting together about 30 to 60% of the total volume of the suspension, wherein the at least one ceramic reinforcement is a short fiber of graphite having a diameter of between about 10 nm (0.01 μm) and 10 μm and a length ranging from 1 to 500 μm;

an organic solvent constituting about 15 to 45% of the volume of the suspension;

a binder and a plasticizer constituting about 30 to 70% of the volume of the suspension;

a dispersant representing about 0.1 to 2% by weight of the ceramic reinforcement and metallic powder; and additives representing about 0.01 to 2% of the mass of the metallic powder and ceramic reinforcement.

2. The process of claim 1, wherein the short fibers have a diameter of between about 0.1 and 10 μm.

3. Process according to claim 1, wherein the viscosity of the suspension (S) is between 0.5 and 3 Pa·s.

4. Process according to claim 1, wherein the binder is a compound that is non-soluble in water chosen from among polyalcohols, vinyl compounds, acrylic compounds and mixtures thereof.

5. Process according to claim 1, wherein the organic solvent is chosen from among cetones, alcohols and mixtures thereof.

6. Process according to claim 1, wherein the dispersant is chosen from among surfactants, fish oil, phosphoric esters, polyacrylates, sulfonates, perfluorates and acids with a carbon chain of 2 to 30 carbon atoms.

7. Process according to claim 1, wherein preparation of the suspension consists of:

grinding the metallic powder and ceramic reinforcement with the solvent and dispersant in a jar mill or by attrition; then adding and mixing a binder and a plasticizer to this substance.

8. Process for preparing a composite part having a laminated structure in which several thin films are formed according to steps a) and b) described in claim 1, and said thin films are stacked and said stack is subjected to thermocompression.

9. Process according to claim 8, wherein the stacked thin films have different compositions.

* * * * *